US005134907A

United States Patent [19]

Branson

[11] Patent Number: 5,134,907

[45] Date of Patent: Aug. 4, 1992

[54] DEVICE FOR USE IN THE INSTALLATION OF FLOORING

[76] Inventor: Daniel Branson, P.O. Box 1109, Darien, Ga. 31305

[21] Appl. No.: 750,904

[22] Filed: Aug. 28, 1991

[51] Int. Cl.[5] ..... E04F 15/00; B26B 3/00; B23P 19/04

[52] U.S. Cl. ..... 81/46; 29/239

[58] Field of Search ..... 81/45, 46; 30/169, 170; 299/36, 37

[56] References Cited

U.S. PATENT DOCUMENTS

| | | | |
|---|---|---|---|
| 274,838 | 3/1883 | Steineke . | |
| 344,101 | 6/1886 | Gift . | |
| 375,147 | 12/1887 | Fredericks . | |
| 559,052 | 4/1896 | Bennett . | |
| 775,092 | 11/1904 | Rosier . | |
| 776,575 | 12/1904 | Weckman . | |
| 811,131 | 1/1904 | Denphis . | |
| 848,160 | 3/1907 | Dampman | 30/170 |
| 864,874 | 9/1907 | Thompson | 30/170 |
| 940,695 | 11/1909 | Junker . | |
| 953,596 | 3/1910 | Corbit . | |
| 1,115,517 | 11/1914 | Duncan | 30/170 |
| 1,231,461 | 6/1917 | Tomcheck . | |
| 1,354,854 | 10/1920 | Scully . | |
| 1,568,885 | 1/1926 | Derby . | |
| 2,588,401 | 3/1952 | Miller . | |
| 2,948,507 | 8/1960 | Gould . | |
| 3,524,623 | 8/1970 | Campbell . | |
| 3,779,515 | 12/1973 | Larios et al. . | |
| 4,324,042 | 4/1982 | Lipka et al. | 29/239 |
| 5,037,160 | 8/1991 | Ukai | 30/170 |

*Primary Examiner*—Douglas D. Watts
*Assistant Examiner*—Paul M. Heyrana, Sr.
*Attorney, Agent, or Firm*—Burns, Doane, Swecker & Mathis

[57] ABSTRACT

An apparatus for facilitating the laying of floor boards on a subfloor includes a base member having an arrangement of subfloor engaging spikes provided on its bottom surface for anchoring the device during operation. A floor engaging member for engaging the floor board being laid is also provided. A handle and yoke assembly is pivotally mounted on the base member in order to operate the floor engaging member, and a transmitting arrangement is connected to the floor board engaging member for transmitting the pivoting movement of the handle and yoke assembly into sliding movement of the floor board engaging member. Additionally, the apparatus is provided with an arrangement that is connected to the base member for preventing the transmitting arrangement from being forced upwardly during operation of the apparatus.

20 Claims, 3 Drawing Sheets

DEVICE FOR USE IN THE INSTALLATION OF FLOORING

FIELD OF THE INVENTION

The present invention pertains to the installation of flooring and more particularly, relates to a device for facilitating the laying of floor boards.

BACKGROUND OF THE INVENTION

The floor boards typically used in the laying and installation of wood or simulated wood flooring are provided with a tongue along one side edge and a groove along the opposite side edge so that the tongue of one floor board fits into the groove in the adjacent floor board. Preferably, the adjacent floor boards should be placed as close as possible to one another to avoid significant spaces and gaps between adjacent floor boards. The flooring installation process usually proceeds by placing a first board at the appropriate place and securing it in place by, for example, nailing it to the underlying subfloor or floor joists. The next board is then placed in close proximity to the previously laid board with the tongue of one floor board fitting into the groove on the adjacent floor board. Once in position, the new floor board is then nailed or secured in the appropriate manner to the underlying subfloor or floor joists. This process continues until the entire floor has been laid.

During the floor installation process, it is not uncommon that the floor boards being laid are warped or bowed along their entire length or along a portion of their length. As can be readily appreciated, the warped or bowed nature of the floor boards makes it difficult to place adjacent boards in close abutting relation to one another.

Typically, a rubber headed hammer is used to force the floor boards into abutting relation with respect to the previously laid floor board, or if the floor board being laid is the first floor board, into abutting relation with respect to the wall. As might be expected, however, the use of such a hammer presents certain difficulties.

For example, pounding the floor boards into position to ensure that they are located as close as possible to one another can cause damage to the tongue and the groove that is formed on the side edges of the floor boards. Moreover, rubber headed hammers are not very effective in aiding the installation of floor boards that are warped or bowed.

As an alternative to the use of rubber headed hammers, various devices have been proposed for use in the installation of floor boards on a subfloor or floor joists. Examples of such devices are disclosed in U.S. Pat. Nos. 1,354,854; 3,779,515; 1,153,106; 2,588,401; 375,147; 775,092; 776,575; 811,131; 174,838; 344,101; 1,568,885; 1,231,461; 953,596; 2,948,507; 3,524,623; 940,695; and 559,052. However, none of these devices has gained widespread use in the industry. Moreover, the devices disclosed in these patent suffer from various disadvantages and drawbacks and are susceptible to improvements.

For example, at least some of the devices disclosed in the aforementioned patents are designed in such a manner that the force exerted by the device is directed to a small area with respect to the entire length of the floor board. These devices are not well suited for applying a force along a substantial portion of the length of the floor board and thus, the ability of these devices to force warped or bowed floor boards into close abutting relation with respect to the previously laid floor board is significantly limited.

Some of the devices disclosed in the aforementioned patents are also designed in such a manner that the force that is imparted to the floor board during use of the device is not substantially parallel to the plane of the flooring, but rather is directed at an angle relative thereto. The greater the angle at which the force is directed relative to the plane of the flooring, the smaller the magnitude of the horizontal component of the force applied by the device. Additionally, damage may result to the floor boards if the floor boards are pushed together at an angle rather than parallel to one another.

Another problem that arises is that there is a tendency for some of the devices disclosed in the aforementioned patents to cause the floor board being laid to kick up out of the plane of the flooring.

Additionally, some of the devices disclosed in the aforementioned patents are designed such that the portion of the device adapted to engage the floor board being laid is specifically configured to match the tongue that extends from one side edge of the board. If the floor board engaging portion of the device is not exactly aligned with the floor board, or if the floor board is displaced slightly or kicks up during use of the device, damage can result to the tongue on the floor board.

SUMMARY OF THE INVENTION

In light of the foregoing drawbacks and disadvantages associated with known devices for installing floor boards, it is a general object of the present invention to provide an improved device for facilitating the installation of floor boards that addresses and overcomes the foregoing disadvantages and drawbacks.

In accordance with one aspect of the present invention, a device for facilitating the installation of flooring on a subfloor includes a base member having an arrangement provided on the bottom surface thereof for anchoring the base member on the subfloor during use, a hinge pad provided on the base member adjacent each end of the base member and a yoke member having a pivot lever extending from each end thereof. The yoke member has a handle extending therefrom and each pivot lever is pivotally mounted on one of the hinge pads to permit the yoke member and the handle to pivot about a pivot axis. A connecting member is pivotally connected to each of the pivot levers, and a guide pin mounting pad is provided on the base member. The guide pin mounting pad has a guide pin extending therefrom and a guide pin receiver pad is connected to one of the connecting members. The guide pin receiver pad has a guide slot formed therein and the guide pin extends through the guide slot to guide the movement of the connecting members. A guide assembly is also provided on the base member and the guide assembly includes a guide plate that overlies one of the connecting members to help prevent the connecting member from being forced upwardly during use. Further, a floor board engaging arrangement is connected to each of the connecting members for engaging a floor board being laid so that upon pivotal movement of the yoke member the connecting members slide in a horizontal direction and thereby cause the floor board engaging arrangement to slide in the same horizontal direction.

In accordance with another aspect of the present invention, an apparatus for facilitating the laying of floor boards on a subfloor includes a base member, an arrangement disposed on the bottom surface of the base member for engaging the subfloor to anchor the apparatus during use, a floor board engaging device for engaging a floor board to be laid, an operating mechanism pivotally mounted on the base member for operating the floor board engaging device, a transmitting arrangement fixedly connected to the floor boar engaging device and pivotally connected to the operating mechanism for transmitting the pivotal motion of the operating mechanism into sliding movement of the floor board engaging device, and an arrangement connected to the base member for preventing the transmitting arrangement from being forced upwardly during operation of the apparatus.

BRIEF DESCRIPTION OF THE DRAWING FIGURES

A further understanding of the present invention will be understood from the description that follows, considered in conjunction with the accompanying drawing figures in which like elements bear like reference numerals, and wherein.

DETAILED DESCRIPTION OF PREFERRED EMBODIMENT

Figure 1:
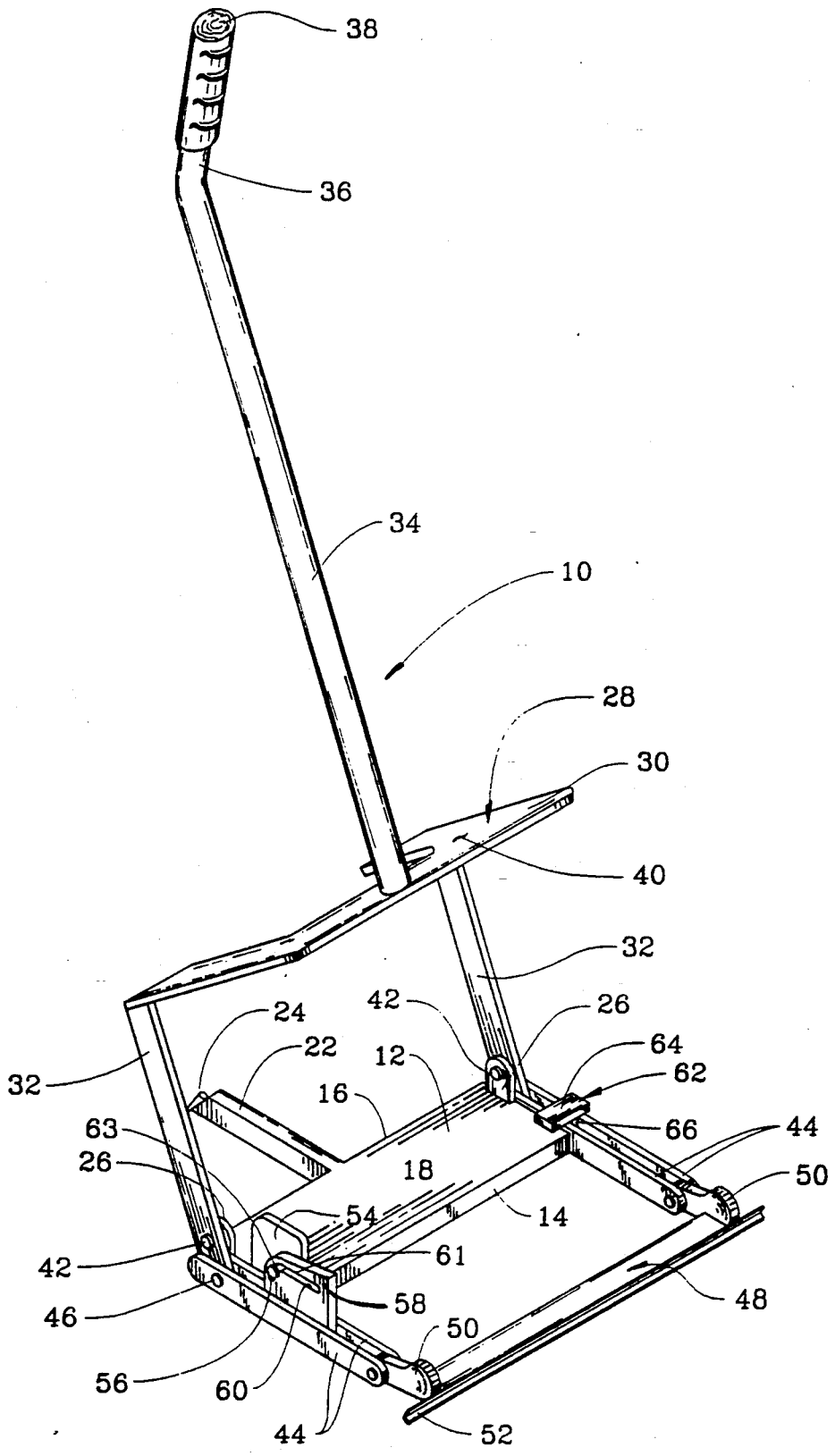
FIG. 1 is a right side perspective view of the device according to a preferred embodiment of the present invention.
Figure 2:
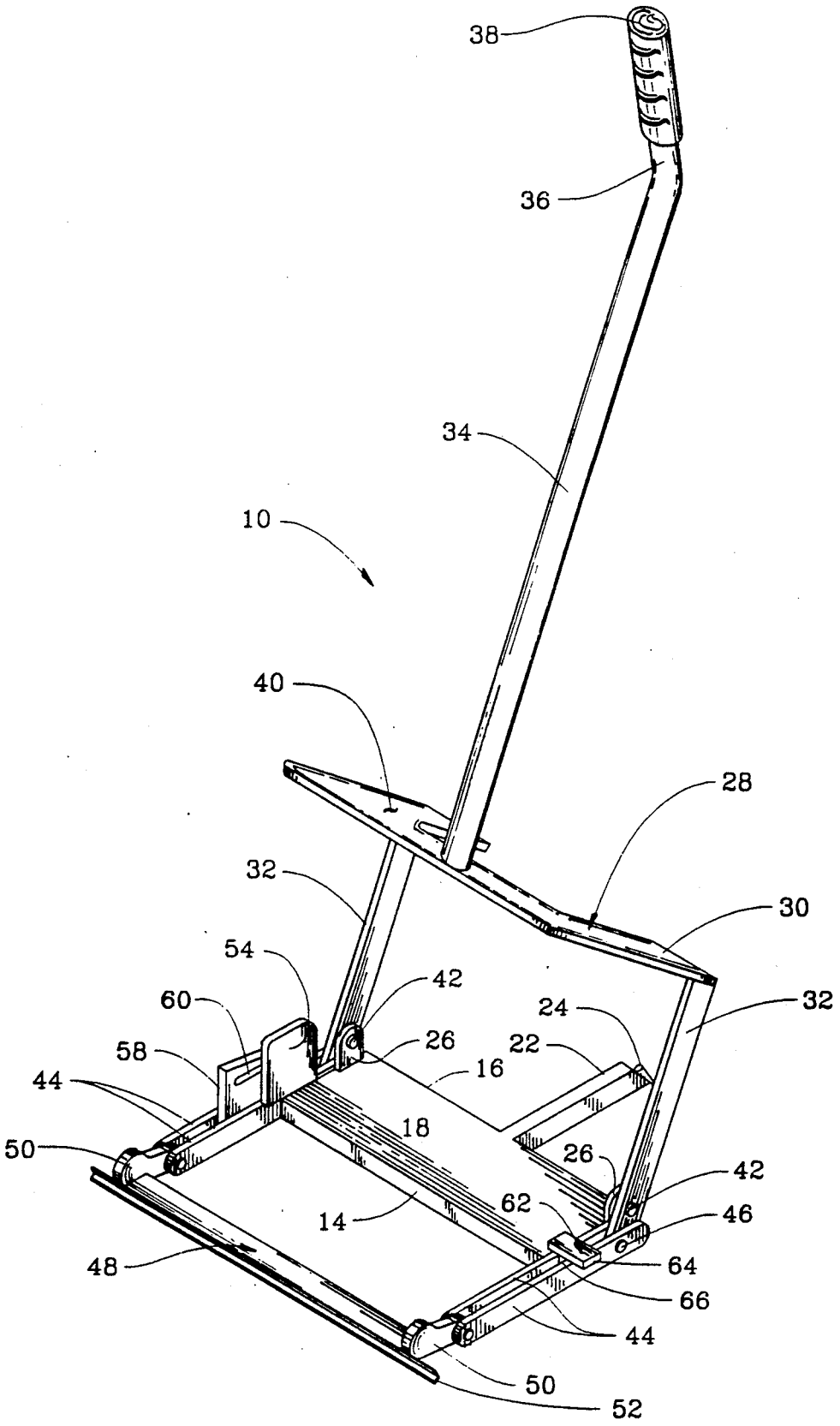
FIG. 2 is a left side view of the device illustrated in FIG. 1.

With reference initially to FIGS. 1 and 2, the device 10 for facilitating the installation of floor boards according to the present invention includes a base member 12 having a front side 14 and a rear side 16. The base member 12 also includes a top surface 18 and an oppositely positioned bottom surface 20 (see FIG. 3).

Extending from the rear side 16 of the base member 12 is a tail piece 22. The tail piece 22 may be integrally formed in one piece with the base member 12 or can be secured to the base member 12 in any suitable manner such as by, for example, welding. As can be seen in FIG. 1 and most clearly in FIG. 3, the free end of the tail piece 22 that is distal from the base member 12 is provided with a spike 24 that serves to anchor the entire device 10 and provide stability during use. Preferably, the point of the spike 24 points rearwardly away from the base member 12.

Each end of the base member 12 is provided with a hinge pad 26. The hinge pads 26 can be formed integrally and in one piece with the remainder of the base member 12 or can be secured in any other appropriate manner to the base member such as by welding. Preferably, the hinge pads 26 extend upwardly from the top surface 18 of the base member 12. The hinge pads 26 provide an arrangement for pivotally mounting a yoke assembly 28 and an attached handle 34.

The yoke assembly 28 includes a yoke member 30 having a pivot lever 32 extending from each end thereof. In the embodiment illustrated, the yoke member 30 is substantially U-shaped, although shapes other than that illustrated could be employed. The pivot levers 32 can be secured to the free ends of the U-shaped member by any suitable means such as welding. Alternatively, the yoke member 30 and the pivot levers 32 can be formed integrally in one piece. The pivot levers 32 are arranged substantially parallel to one another.

The handle 34 is secured to the yoke member 30 in any suitable manner. For example, the yoke member 30 could be provided with a handle lug that extends outwardly away from the face of the yoke member 30. The handle 34 could then be provided with a hollow portion into which fits the handle lug. Aligned holes could also be provided in the handle 34 and the handle lug so as to permit the handle to be secured to the handle lug. Alternatively, the handle 34 could be simply secured directly to the yoke member 30 in any suitable manner such as by welding. It can be seen from FIGS. 1 and 2 that the handle 34 is disposed generally perpendicular with respect to the surface 40 of the yoke member 30.

As can be seen from the drawing figures, the free end 36 of the handle 34 can be bent in the forward direction at a suitable angle to make the handle more ergonomically suitable and thereby facilitate the gripping and operation of the handle 34 during use. The extent to which the free end portion 36 of the handle 34 can be angularly oriented is variable. However, an angle of approximately 30 degrees is useful. The free end 36 of the handle can also be provided with a suitable handle grip 38.

Each of the pivot levers 32 is provided with a pin 42 that extends inwardly towards the opposite pivot lever 32. Preferably, the pins 42 are aligned with one another such that their longitudinal axes are substantially aligned and collinear.

The pins 42 extending from each of the pivot levers 32 are positioned in through holes that extend through the hinge pads 26. In that way, the handle 34 and the yoke assembly 28 are pivotally mounted with respect to the base member 12. As can be seen from the various drawing figures, the pins 42 are preferably spaced from the free ends of the respective pivot levers 32.

While the preferred embodiment illustrated in the drawing figures shows the pins 42 mounted on the pivot levers 32, it is to be understood that the hinge pads 26 could be provided with pins while the pivot levers 32 are provided with through hole for receiving the pins.

Each of the pivot levers 32 is also pivotally connected to a pair of connecting arms 44 that are arranged parallel with respect to one another. Preferably, the two connecting arms 44 are secured on opposite sides of the respective pivot levers 32, thereby resulting in the connecting arms 44 of each pair being spaced apart from one another. A pivot pin connection 46 is provided between each of the pivot levers 32 and its respective pair of connecting arms 44 to permit pivotal movement between the pivot levers 32 and the connecting arms 44. The pivot pin connection 46 can consist of a pin which extends through aligned holes provided in the end of each pivot lever 32 and the respective connecting arms 44. As can be seen from the drawing figures, the pivot pin connection 46 that connects the pivot levers 32 to their respective connecting arms 44 is positioned closer to the free end of the respective pivot levers 32 than the pins 42 which connect the pivot levers 32 to their respective hinge pads 26.

A floor board engaging assembly 48 is connected to the end of each of the connecting arms 44 located distal from the pivot pin connection 46. Preferably, the floor board engaging assembly 48 is fixedly connected to the ends of the connecting arms 44. For example, the mounting portions 50 of the floor board engaging assembly 48 can be fixedly secured to their respective connecting arms 44 by way of plug welds. The connecting arms 44 define a connecting and transmitting arrangement for connecting the pivot levers 32 to the floor board engaging assembly 48, and for transmitting pivoting movement of the yoke assembly 28 and the handle 34 to the floor board engaging assembly 48.

The front portion of the floor board engaging assembly 48 is provided with a substantially V-shaped floor board engaging member 52. The floor board engaging member 52 is designed and configured to help prevent damage to the floor boards during the floor board laying process. When the floor board engaging member 52 is placed against the side edge of the floor board being laid, the legs of the V-shaped engaging member 52 contact the shoulders of the floor board (i.e., the top and bottom edges of the side of the floor board) so that the tongue extending from the side of the floor board fits into the area between the legs of the V-shaped floor board engaging member 52. In that way, the tongue extending from the side of the floor board does not become damaged as a result of contact with the floor board engaging member 52.

To help guide the movement of the connecting arms 44 and the yoke assembly 48 in the horizontal direction and to help prevent the connecting arms 44 from kicking upwardly during use of the device a guide pin mounting pad 54 is provided at one end of the base 12. The guide pin mounting pad 54 is fixedly mounted on the base 12 and can extend upwardly away from the top surface 18 of the base 12. Extending outwardly from one side of the guide pin mounting pad 54 is a guide pin 56.

The guide pin 56 extends into a guide slot 60 formed in a guide pin receiver pad 58. The guide pin receiver pad 58 can be positioned between the two connecting arms 44 and can be secured to one or both of the connecting arms 44 in any suitable manner such as, for example, by welding. The guide slot 60 in the guide pin receiver pad 58 includes a portion 61 that extends generally horizontally and a portion 63 that curves slightly downwardly (i.e., in the direction of the base member 12). The slightly downwardly curved portion 63 is positioned such that the guide pin 56 is positioned in the slightly downwardly curved portion 63 when the floor board engaging member 52 is in its forwardmost position.

It can be readily seen, therefore, that during horizontal movement of the connecting arms 44 and the angle pad 48, the guide pin 56 moves along the length of the guide slot 60 formed in the guide pin receiver pad 58 to thereby guide the connecting arms 44 and the hinge pad 48 in a substantially horizontal direction. Once the floor board engaging member 52 has reached its forwardmost position, the guide pin 56 is positioned in the slightly downwardly extending portion 63 of the guide slot to thereby "lock" the floor board engaging member 52 in that position. By "locking" the floor board engaging member 52 in that position, the user can nail the floor board being laid to the underlying subfloor or floor joists.

To further facilitate guidance of the connecting arms 44 and the angle pad 48, a guide assembly 62 is provided on the base member 12 at a position opposite the position of the guide pin mounting pad 54. The guide assembly 62 includes a guide plate 64 that overlies both of the connecting arms 44. Of course, it is possible that the guide plate 64 can be positioned so as to overlie only one of the connecting arms 44 (i.e., the connecting arm closest to the base member 12). The guide assembly 62 further includes a guide extension 66 fixedly secured to the guide plate 64 and extending downwardly between the connecting arms 44.

The guide assembly 62 serves to guide the movement of the connecting arms 44 in the horizontal direction because the guide plate 64 prevents the connecting arms 44 from being forced upwardly during use. Also, the guide assembly 62 helps prevent the connecting arms 44 from moving side to side as a result of the positioning of the guide extension 66 between the connecting arms 44.

Figure 3:
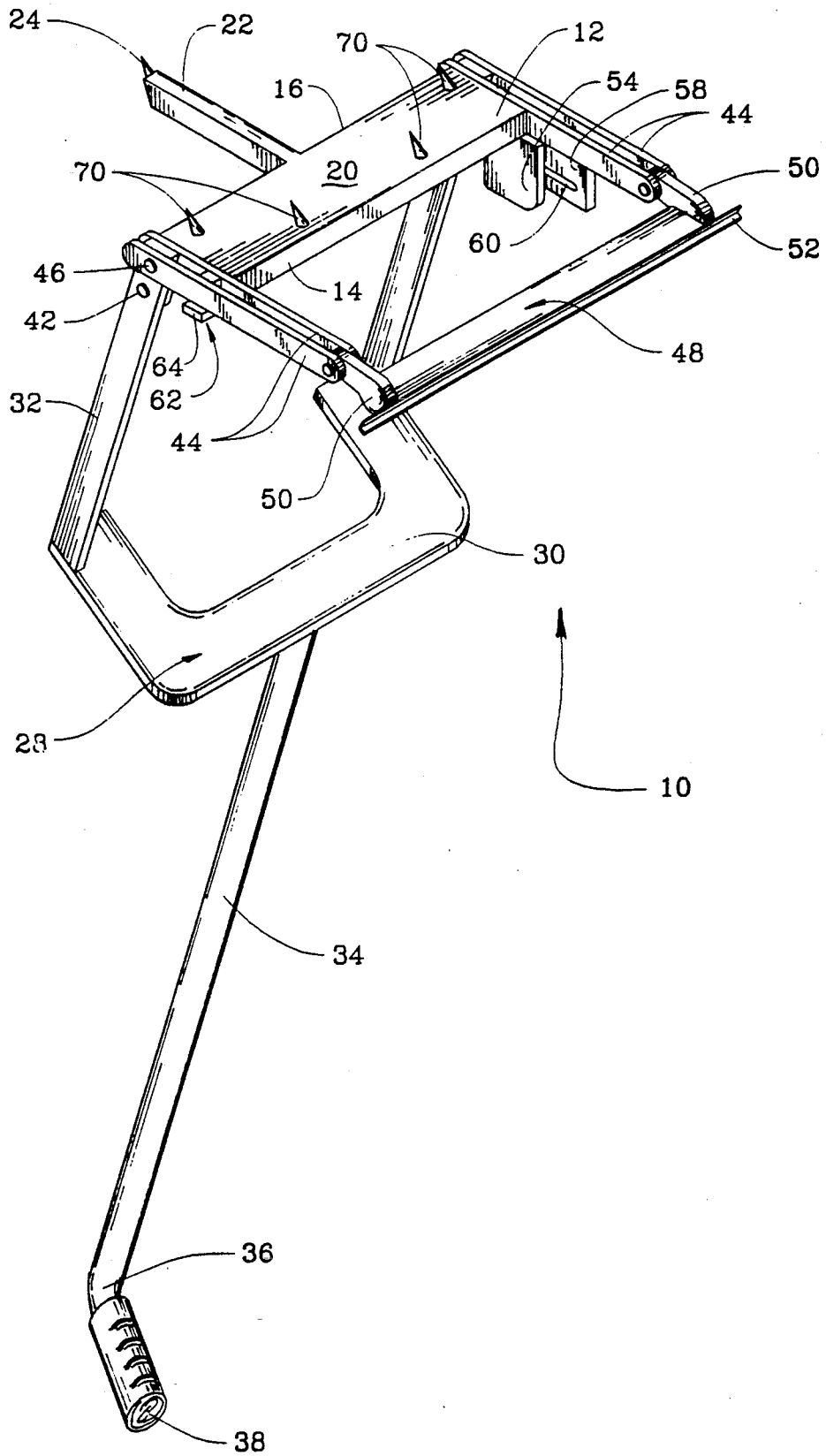
FIG. 3 is a bottom perspective view of the device illustrated in FIG. 1.

As can be seen most clearly in FIG. 3, the bottom surface of the base member 12 is provided with a plurality of spikes 70 for anchoring the base member 12, as well as the entire device 10, to the subfloor during use. It has been found that four spikes 70 angled toward the rear side 16 of the base member 12 provide sufficient anchorage for maintaining the base member in position during use. If too many spikes 70 are provided, it may be difficult to remove the base member 12 from the subfloor after installation of a floor board. On the other hand, if an insufficient number of spikes are provided, the base member 12 will not be sufficiently anchored during use and the ability of the device to facilitate the installation of floor boards, particularly warped or bowed floor boards, may be hindered. The use of four spikes angled rearwardly as shown in FIG. 3 is believed to provide a good compromise between the foregoing considerations.

The combination of the rearwardly angled spikes 70 on the bottom 16 of the base member 12 and the rearwardly angled spike 24 provided on the rearwardly extending tail piece 22 provides a flooring installation device that is quite stable and well anchored during use. As a result, it is unlikely that the base member 12 will become dislodged from the subfloor and forced upwardly during use.

As illustrated in FIGS. 1 and 2, the floor engaging member 52 is in its forwardmost position. To install a floor board, the handle 34 is pushed forwardly from the position illustrated in FIG. 1 (i.e., to the right as seen in FIG. 1), thereby causing the yoke assembly 28 to also pivot forwardly in the clockwise direction as seen from the side of the device illustrated in FIG. 1. The yoke assembly 28 and the handle 34 pivot about a pivot axis defined by the longitudinal axe of the pins 42. The floor engaging member 52 is then placed against a floor board that is to be laid such that the two legs of the V-shaped floor engaging member 52 contact the shoulders of the floor board. By stepping on the base member 12, the spikes 70 extending from the bottom surface 20 of the base member 12 and the spike 24 extending from the tail piece 22 ca be securely anchored in the subfloor. Thereafter, the handle 34 can be pulled rearwardly so as to cause the pivot lever 32 of the yoke assembly 28 to pivot in the counterclockwise direction as seen from the side of the device shown in FIG. 1. This movement of the yoke assembly 28 causes the connecting arms 44 to slide forwardly in the horizontal direction thereby forcing the floor board being laid into close abutting relation with respect to the previously laid floor board, or if the floor board is the first floor board being laid, against the wall.

Because of the arrangement of the various combination of parts in the device according to the present invention, substantially all of the pivoting movement of the handle 34 and the yoke assembly 28 is translated into horizontal sliding movement of the connecting arms 44 and the floor board engaging assembly 48. The device 10 according to the present invention provides a large mechanical advantage such that the user need apply relatively little force in pulling the handle rearwardly (i.e., toward the user) in order to produce a relatively large horizontal force that forces the floor board being laid into close abutting relation to the previously laid floor board, or the wall.

The device 10 according to the preferred embodiment of the present invention is also well suited for ensuring that the connecting arms 44 and the floor board engaging assembly 48 do not kick upwardly when a floor board is being forced into abutting relation with respect to the previously laid floor board or the wall. In particular, the guide assembly 62 helps ensure that the connecting arms 44 are not forced upwardly as a result of the counteracting force applied thereto during installation of a floor board. Also, the guide extension 66 extending from the guide plate 64 guides the connecting arms 44 in a substantially straight line of movement, thereby preventing the connecting arms 44 from skewing outwardly and being stressed. This can help reduce stress on the pivot connection 46. The interaction between the guide pin 56 extending from the guide pin mounting pad 54 and the guide slot 60 formed in the guide pin receiver pad 58 also contributes to ensuring that the connecting arms 44 and the floor board engaging assembly 48 move in a substantially horizontal plane of movement.

The construction of the device 10 is also such that the connecting arms 44 and the floor board engaging assembly 48 move in a plane of movement that is substantially the same as the plane of the flooring. This means that the force applied to the floor board being laid is substantially parallel to the plane of the previously laid floor boards which means that the floor boards will not become damaged as a result of the floor boards being brought together at an angle with respect to one another. Also, it is easier to bring the floor board being laid into close abutting relation with respect to the previously laid floor board.

The device 10 according to the preferred embodiment of the present invention is also useful in the laying of floor boards that are warped or bowed along portion of their length or their entire length. The connecting arms 44 are connected, by way of the mounting members 50, to the floor board engaging member 52 at points adjacent the ends of the floor board engaging member 52. Thus, the force that is applied to the floor engaging member 52 by way of the connecting arms 44 is distributed over the length of the floor engaging member 52. Consequently, if the floor board being laid is warped or bowed, the floor board engaging member 52 is able to apply a force to the floor board that is distributed along the length of the floor board or a substantial portion of the length of the floor board in such a manner as to counteract the warped or bowed nature of the floor board and thereby bring the floor board into close abutting relation with respect to the previously laid floor boards. The significant mechanical advantage provided by the device 10 according to the present invention also contributes to the device's ability to achieve this objective.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art and equivalents employed without departing from the spirit of the present invention. Accordingly, the foregoing detailed description should be considered illustrative in nature and not limited to the scope and spirit of the invention as set forth in the appended claims.

What is claimed is:

1. A device for facilitating the installation of flooring on a subfloor, comprising:

a base member having a bottom surface, an oppositely positioned top surface and oppositely positioned ends, said base member having anchorage means provided on the bottom surface thereof for anchoring the base member on the subfloor during use;

a hinge pad provided on the base member adjacent each end of the base member;

a yoke member having oppositely positioned ends, said yoke member having a pivot lever extending from each end thereof and said yoke member having a handle extending therefrom, each pivot lever being pivotally mounted on one of said hinge pads to permit the yoke member and the handle to pivot about a pivot axis;

a connecting member pivotally connected to each of the pivot levers;

a guide pin mounting pad provided on the base member, said guide pin mounting pad having a guide pin extending therefrom;

a guide pin receiver pad connected to one of the connecting members, said guide pin receiver pad having a guide slot formed therein and said guide pin extending through the guide slot to g guide the movement of the connecting members; and a guide assembly provided on the base member, said guide assembly including a guide plate that overlies one of the connecting members to help prevent the connecting member from being forced upwardly during use; and floor board engaging means connected to each of said connecting members for engaging a floor board being laid so that upon pivotal movement of said yoke member said connecting members slide in a horizontal direction and thereby cause the floor board engaging means to slide in the same horizontal direction.

2. The device according to claim 1, wherein said yoke member is substantially U-shaped.

3. The device according to claim 2, wherein said yoke member lies in a plane and said handle extends substantially perpendicular to said plane.

4. The device according to claim 1, including a tailpiece connected to and extending from the base member in a direction away from the floor board engaging means, said tailpiece having a spike provided at an end thereof distal from the base member for engaging the subfloor, said spike being angled such that a point of the spike points away from the base member.

5. The device according to claim 4, wherein each of said connecting members includes two connecting arms mounted on opposite sides of the respective pivot lever.

6. The device according to claim 5, wherein said guide assembly includes a guide extension extending from the guide plate, said guide extension extending between the connecting arms of the connecting member which the guide plate overlies.

7. The device according to claim 1, wherein said flooring engaging means is substantially V-shaped in cross-section.

8. The device according to claim 1, wherein said anchorage means includes a plurality of spikes extending away from the bottom surface of the base member, each of said spikes having a point and the spikes being arranged such that the points of the spikes point away from the floor board engaging means.

9. The device according to claim 1, wherein a portion of said guide slot extends substantially horizontally and another portion of said guide slot extends downwardly towards the connecting number to which the guide pin receiver pad is connected.

10. An apparatus for facilitating the laying of floor boards on a subfloor, comprising:

a base member having oppositely disposed ends;

means disposed on a bottom surface of the base member for engaging the subfloor to anchor the apparatus during use;

floor board engaging means for engaging a floor board to be laid;

operating means pivotally mounted on said base member for operating the floor board engaging means;

transmitting means fixedly connected to said floor board engaging means and pivotally connected to said operating means for transmitting the pivotal motion of the operating means into sliding movement of the floor board engaging means; and means connected to said base member for preventing said transmitting means from being forced upwardly during operation of the apparatus.

11. The apparatus according to claim 10, wherein said floor board engaging means includes two mounting portions connected to a floor board engaging member, each of said mounting portions being connected to said floor board engaging member at points adjacent ends of the floor board engaging member, said transmitting means including at least two connecting members, each of the connecting members being connected to one of the mounting portions of the floor board engaging means, and each of said connecting members being pivotally connected to the operating means.

12. The apparatus according to claim 11, wherein each of said connecting members includes a pair of connecting arms arranged parallel with respect to one another.

13. The apparatus according to claim 12, wherein said operating means includes two spaced apart and substantially parallel pivot levers, each of said pivot levers being pivotally connected to one of the pairs of connecting arms.

14. The apparatus according to claim 13, wherein each of the pivot levers extends between the pair of connecting arms to which the pivot lever is pivotally connected.

15. The apparatus according to claim 10, wherein said transmitting means includes two spaced apart and parallel connecting members, said means for preventing said transmitting means from being forced upwardly including a guide plate fixedly connected to the base member and overlying one of the connecting members.

16. The apparatus according to claim 15, wherein each of said connecting members includes two spaced apart connecting arms, said guide plate having a guide extension extending therefrom that is positioned between the connecting arms of one connecting member.

17. The apparatus according to claim 10, including a tail piece connected to the base member and extending from the base member in direction away from the floor boards engaging means.

18. The apparatus according to claim 10, including a guide pin mounting pad fixedly secured to the base member, said guide pin mounting pad having a guide pin extending therefrom, and including a guide pin receiver pad fixedly connected to said transmitting means, said guide pin receiver pad having guide slot formed therein and said guide pin extending into said guide slot.

19. The apparatus according to claim 18, wherein a portion of said guide slot extends horizontally and a portion of said guide slot curves downwardly towards the transmitting means.

20. The apparatus according to claim 10, wherein said floor board engaging means includes a floor board engaging member having a substantially V-shaped cross-section.

* * * * *